US005230914A

United States Patent [19]

Akervik

[11] Patent Number: 5,230,914

[45] Date of Patent: Jul. 27, 1993

[54] METAL FOIL FOOD PACKAGE FOR MICROWAVE COOKING

[75] Inventor: Myron Akervik, Duluth, Minn.

[73] Assignee: Luigino's, Inc., Duluth, Minn.

[21] Appl. No.: 694,643

[22] Filed: May 2, 1991

[51] Int. Cl.[5] ..... B65D 81/34

[52] U.S. Cl. ..... 426/107; 206/497; 219/10.55 E; 229/125.35; 229/3.5 MF; 426/124; 426/234

[58] Field of Search ..... 426/107, 113, 124, 234, 426/243; 219/10.55 E; 206/497; 229/DIG. 12, 3.5 MF, 125.19, 125.35, 903

[56] References Cited

U.S. PATENT DOCUMENTS

| | | | |
|---|---|---|---|
| 3,281,051 | 10/1966 | O'Brien et al. | 426/113 |
| 3,468,412 | 9/1969 | Forman | 206/497 |
| 3,495,758 | 2/1970 | Wienecke | 229/125.19 |
| 3,664,498 | 5/1972 | Dulmage | 229/DIG. 12 |
| 2,695,744 | 11/1954 | Gattuso | 229/3.5 MF |
| 3,715,073 | 2/1973 | Gibbs et al. | 229/125.35 |
| 3,854,023 | 12/1974 | Levinson | 426/107 |
| 3,881,027 | 4/1975 | Levinson | 426/243 |
| 3,922,362 | 11/1975 | Pierce | 426/396 |
| 3,938,730 | 2/1976 | Detzel et al. | 229/903 |
| 3,941,967 | 3/1976 | Sumi et al. | 426/107 |
| 3,976,795 | 8/1976 | Ando | 426/396 |
| 3,985,990 | 10/1976 | Levinson | 426/243 |
| 3,985,991 | 10/1976 | Levinson | 426/243 |
| 4,027,132 | 5/1977 | Levinson | 426/243 |
| 4,122,324 | 10/1978 | Falk | 426/243 |
| 4,196,331 | 4/1980 | Leveckis et al. | 426/107 |
| 4,266,108 | 5/1981 | Anderson et al. | 426/243 |
| 4,306,133 | 12/1981 | Levinson | 426/243 |
| 4,388,335 | 6/1983 | Schiffman et al. | 426/243 |
| 4,439,656 | 3/1984 | Peleg | 426/234 |
| 4,558,198 | 12/1985 | Levendusky | 426/243 |
| 4,560,850 | 12/1985 | Levendusky et al. | 426/243 |
| 4,594,492 | 6/1986 | Marosrek | 426/113 |
| 4,663,506 | 5/1987 | Bowen et al. | 426/243 |
| 4,701,585 | 10/1987 | Stewart | 426/243 |
| 4,703,148 | 10/1987 | Mikulski et al. | 426/107 |
| 4,825,024 | 4/1989 | Seaborne | 426/113 |
| 4,851,631 | 7/1989 | Wendt | 426/107 |
| 4,870,233 | 9/1989 | McDonald | 426/107 |
| 4,876,427 | 10/1989 | Mode | 426/243 |
| 4,916,280 | 4/1990 | Havette | 426/107 |
| 4,962,849 | 10/1990 | Anderson | 229/125.35 |
| 4,968,865 | 11/1990 | Seaborn et al. | 426/234 |

*Primary Examiner*—Steven Weinstein

[57] ABSTRACT

The present invention includes a microwavable food product package that has a container with a metal foil tray. The tray has a base, upstanding side and end walls and an outwardly extending upper rim on the walls with the walls being inclined outwardly from the base. A lid made of a material that shields the metal foil tray from microwaves overlies the tray. The lid includes a top panel and side and end panels with a top panel being supported by the upper rim of the tray walls and the panels of the lid being bent downwardly and inwardly about score lines. The height of the panels correspond substantially to the height of the tray so that when the lid rests on the tray rim the lower edges of the panels shield the metal foil tray from microwaves when the package is in a microwave oven such that no arcing occurs.

2 Claims, 3 Drawing Sheets

METAL FOIL FOOD PACKAGE FOR MICROWAVE COOKING

FIELD OF THE INVENTION

This invention relates generally to microwave cooking. It relates particularly to food product packaging and a container which holds the food product while it is being cooked in a microwave oven.

BACKGROUND OF THE INVENTION

Prepared food products suitable for microwave cooking are frequently packaged in trays formed of heavy aluminum foil. The trays are filled with product between their upstanding sidewalls and closed with a plastic or cardboard cover by crimping the tops of the side walls over the edges of the cover. The product is then frozen, shipped and sold in the containers, which serve as packaging for it.

The packaging carries cooking instructions which normally require opening the container and removing the product from the aluminum tray. The instructions usually call for placing the product in a plastic dish or some other "microwaveable" container and covering it partially, or completely, with plastic kitchen wrap material.

SUMMARY OF THE INVENTION

The present invention is embodied in improved packaging for microwaveable food products.

An object of the invention is to provide improved packaging including an aluminum foil tray which is, nevertheless, suitable for use in a microwave oven.

It is another object to provide improved packaging including a container comprising an aluminum tray and cover which can be used during cooking in a microwave oven.

It is a further object to provide improved packaging which includes a plastic film overwrap of the cover and tray.

It is still another object to provide a container for use during microwave cooking which comprises an aluminum tray and a cover enclosing the top and sides of the tray during microwave cooking.

The foregoing and other objects are realized in accord with the present invention by providing a heavy aluminum foil tray with upstanding side walls. The side walls are inclined outwardly from the base of the tray and terminate in a conventional, roll-formed upper rim. A paperboard lid overlies the rim on the side walls. The lid includes a top panel which rests on the tray rim, and side panels which extend downwardly outside the side walls. The height of each side panel corresponds substantially to the height of the tray so that, when the lid rests on the tray rim with the side panels extending down perpendicular to the top panel, the lower edges of the side panels just engage the surface on which the tray is resting.

For marketing, the tray is first filled with product. The lid is then placed over the filled tray. A plastic film is then used to shrink-wrap the tray and lid, drawing the side panels inwardly against the tray side walls to form packaging for the product. The ends of each side panel are beveled to permit drawing the panels tightly against the tray side walls. The packaged product is then frozen.

To cook the product with microwave energy, the purchaser removes the plastic film and places the covered tray in the microwave oven. The unrestrained side panels on the lid naturally move outwardly into approximately perpendicular relationship with the cover. In this position they completely prevent arcing between the aluminum tray and the sides of the microwave oven. Even where the side panels of the lid are cut off at their beveled ends, no arcing occurs because the side walls of the tray are inclined inwardly at an angle behind the panels.

BRIEF DESCRIPTION OF THE DRAWINGS

The invention, including its construction and method of operation, is illustrated more or less diagrammatically in the drawings, in which.

DESCRIPTION OF THE PREFERRED EMBODIMENT

Figure 1:
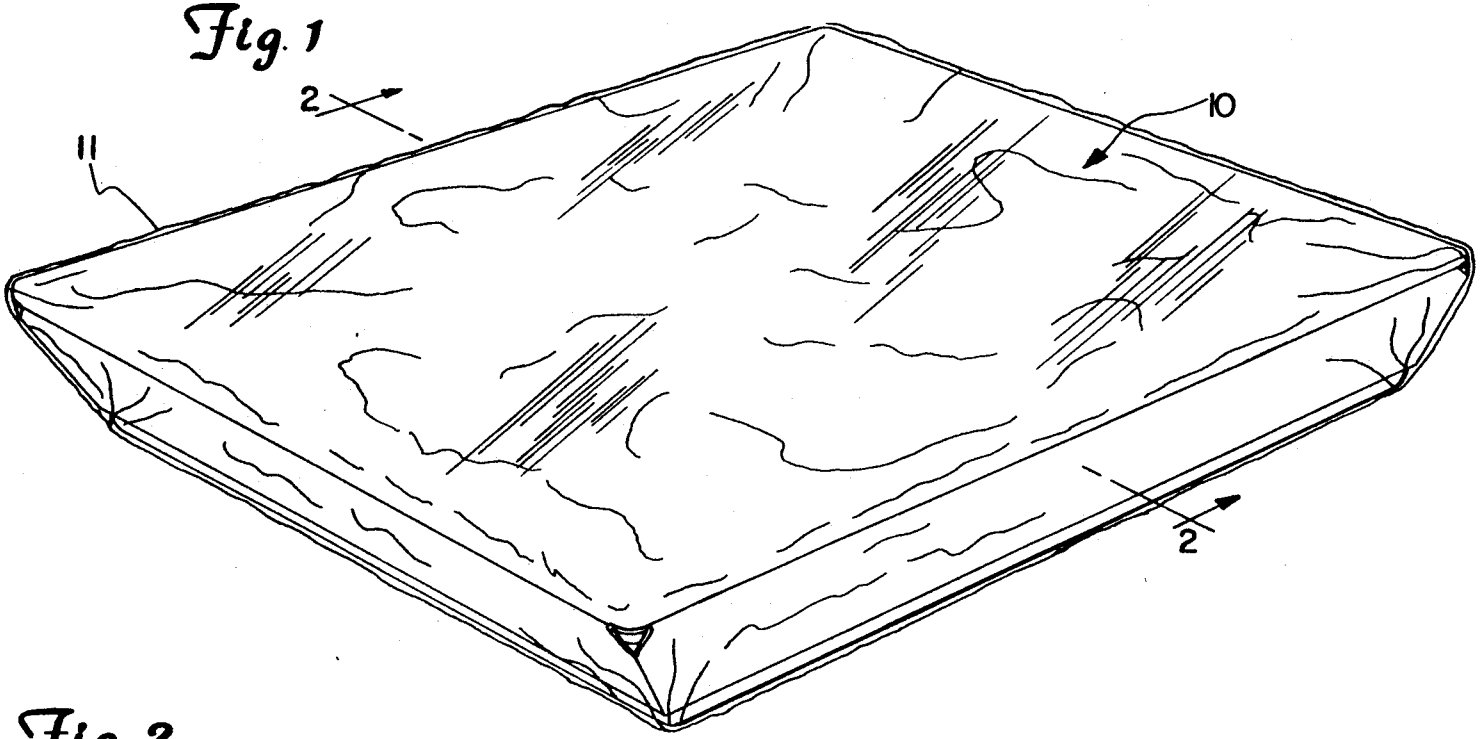
FIG. 1 is a perspective view of packaging embodying features of the present invention, as it appears for marketing products.
Figure 2:
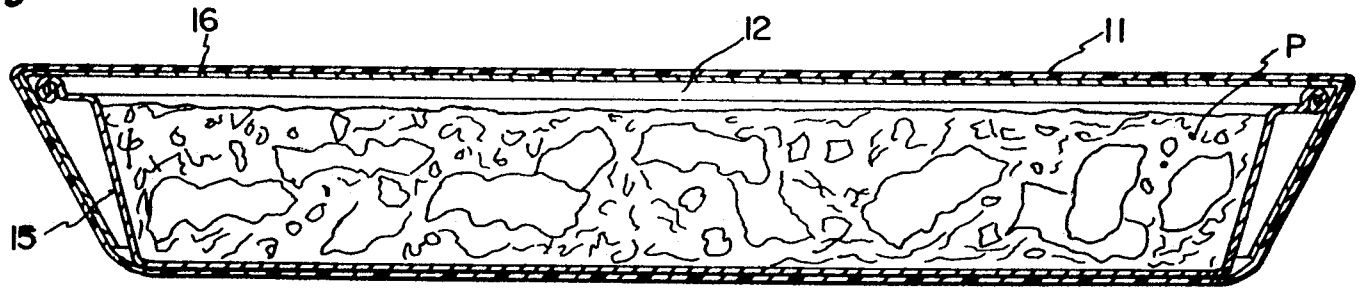
FIG. 2 is a sectional view taken along line 2—2 of FIG. 1.

Referring now to the drawings, and particularly to FIGS. 1 and 2, food product packaging embodying features of the present invention is shown generally at 10. The packaging 10 includes a transparent plastic film 11 which is shrink-wrapped onto a container 12 containing a food product P.

As seen in FIG. 2, the container 12 comprises a tray 15 and a lid 16. The tray 15 is formed of heavy aluminum foil. The lid 16 is formed of paperboard.

Figure 4:
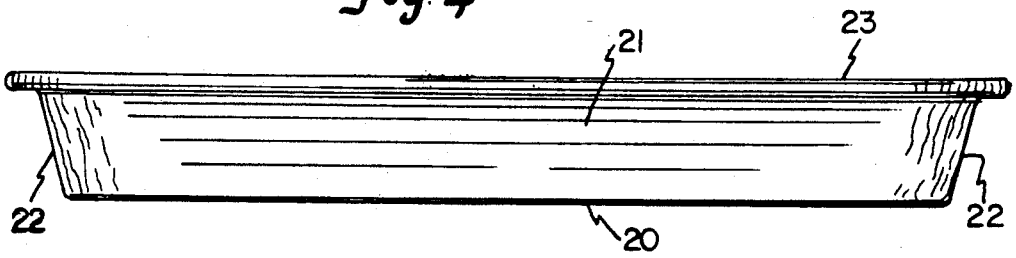
FIG. 4 is a side view of the tray taken along line 4—4 of FIG. 3.
Figure 3:
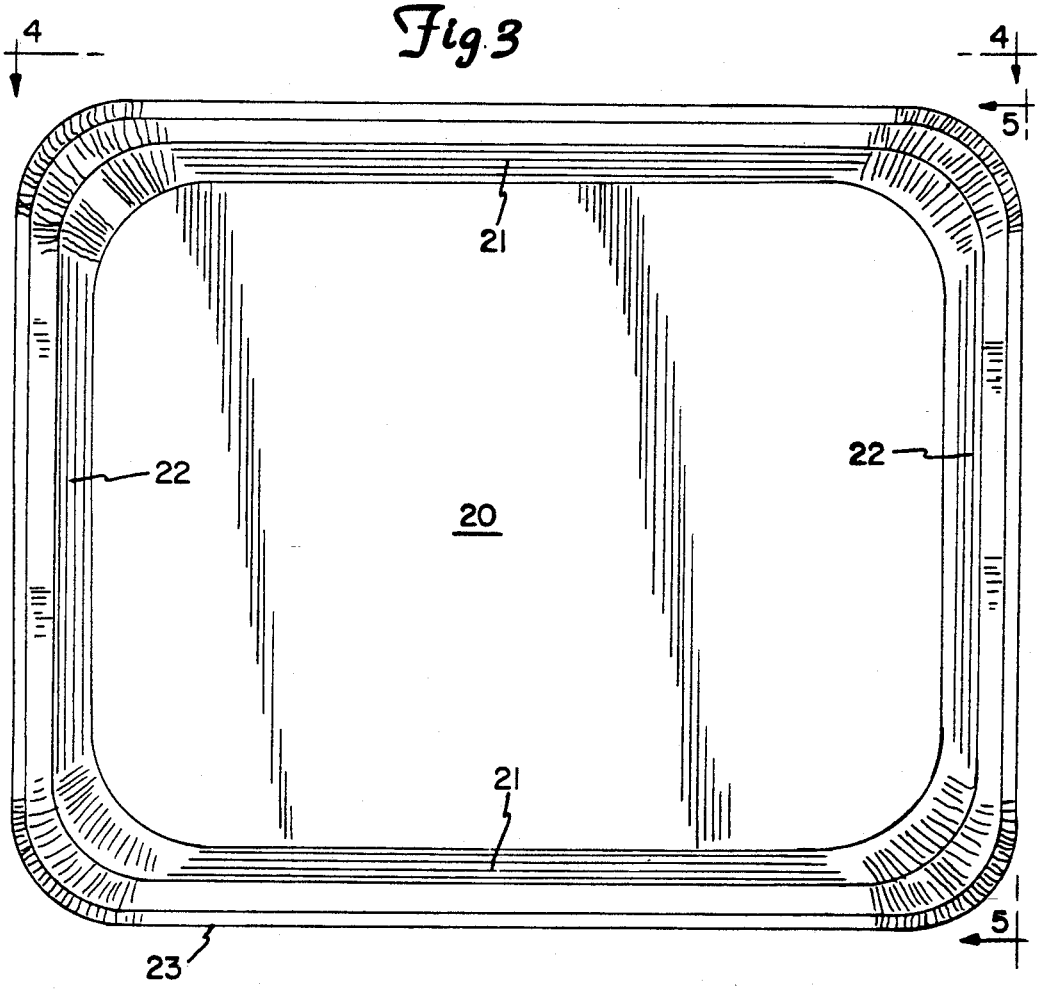
FIG. 3 is a top plan view of the container tray alone.
Figure 5:
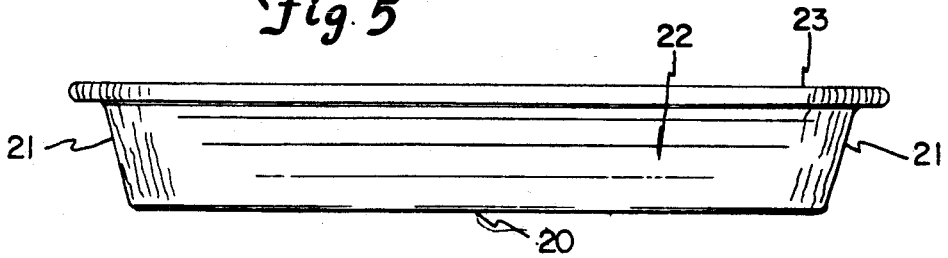
FIG. 5 is an end view of the tray taken along line 5—5 of FIG. 3.

Referring to FIGS. 3–5, the tray 15 includes a base 20 and upstanding side walls 21 and end walls 22. The side walls 21 and end walls 22 are formed unitarily with the base 20. They terminate in a continuous, outwardly extending upper rim 23 which is formed by rolling the aluminum foil.

The side walls 21 and end walls 22 are inclined outwardly to an angle of about 15° to the vertical. The rim 23 protrudes outwardly about one-half inch from each side wall 21 and 22. Accordingly, the outer periphery of the rim 23 is spaced well outside the outer periphery of the base 20. The rim 23 is spaced one-and-five-eighths inches above the base 20 in the example shown.

Figure 7:
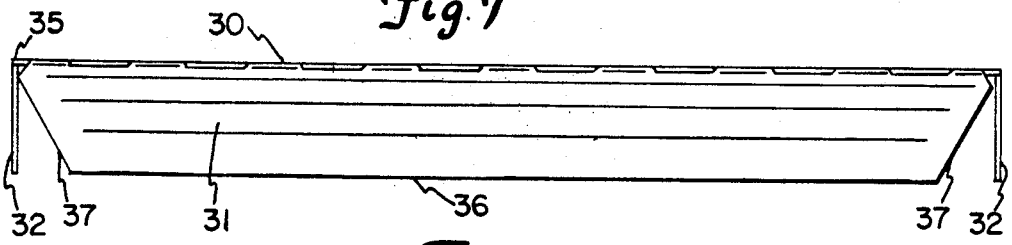
FIG. 7 is a side view of the lid taken along line 7—7 of FIG. 6.
Figure 6:
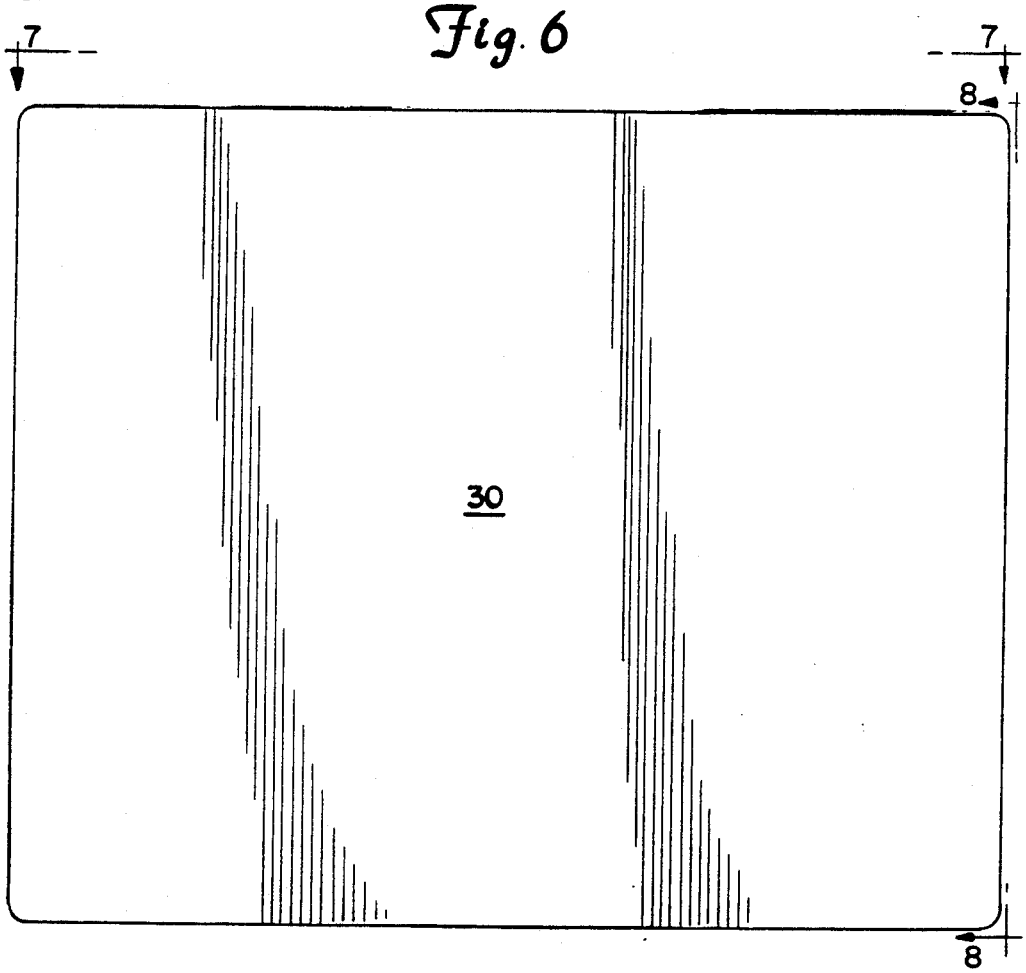
FIG. 6 is a top plan view of the container lid alone.
Figure 8:
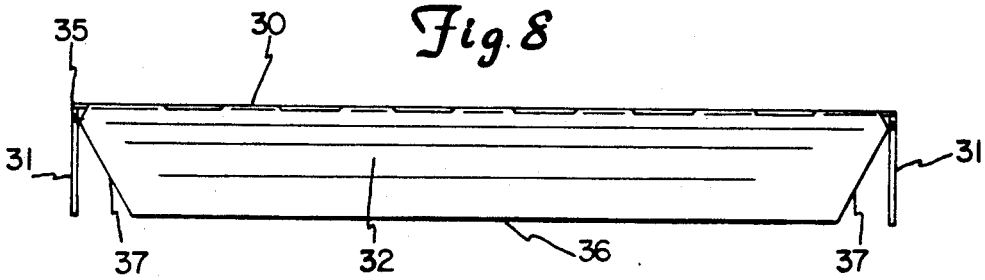
FIG. 8 is an end view of the lid taken along line 8—8 of FIG. 6.

Referring to FIGS. 6–8, the lid 16 includes a top panel 30, two side panels 31, and two end panels 32. The lid 16 is scored at the juncture of the top, side and end panels 30–32 so that the side and end panels fold downwardly on the score lines 35 with ease.

The side and end panels 31 and 32 are one-and-five-eighths inches high from the score lines 35 to their lower edges 36 in the example shown. At their opposite ends they are beveled inwardly at about twenty-two-and-one-half degree angles, as seen at 37 on each of the side and end panels 31 and 32.

Referring again to FIGS. 1 and 2, when the product P has been packed in the tray 15 and the lid 16 seated over it, shrink-wrapping a plastic film 11 over the resultant container 12 causes the side and end panels 31 and 32 of the lid 16 to be drawn tightly in against the side and end walls 21 and 22 of the tray. The ends 37 of the side and end panels 31 and 32, being beveled, do not interfere with each other. In this relationship the lower edges 36 of the side and end panels 31 and 32 terminate short of the base 20 in the tray 15.

The product is marketed in this way. When the purchaser wishes to microwave the contents of the package, the shrink wrap film 11 is removed. This permits the side and end panels 31 and 32 of the lid 16 to flex outwardly. When they are perpendicular to the top panel 30, their lower edges rest loosely against the surface on which the tray base 20 rests. This is the floor of the microwave oven when the container 12 is placed in the oven.

Normal microwave cooking of the product P can then be effected. The side and end panels 31 and 32 of the lid 16 completely shield the aluminum tray 15 from the side walls of the oven. No arcing can take place.

The container 12 of the present invention permits microwave cooking without fuss or bother. The product P can be cooked in its original aluminum tray 15. Furthermore, the original packaging lid 16 serves not only as a marketing component but as an arcing barrier during cooking.

It should be understood that a range of changes and modifications can be made to the preferred embodiment described above. It is therefore intended that the foregoing detailed description be regarded as illustrative rather than limiting, and that it be understood that the invention is defined by the following claims, including all equivalents.

I claim:

1. A microwavable food product package for microwave cooking, comprising:

A) a container containing food to be microwaved before consumption;

B) said container including a tray formed of metal foil and having a base, upstanding side and end walls and an outwardly extending upper rim on said walls; said side and end walls being inclined outwardly from said base;

C) said container also including a lid made of a material that shields the metal foil tray from a microwave oven when placed therein such that no arcing occurs, the lid overlying said tray;

D) said lid including a top panel and side and end panels;

E) said top panel being supported by said upper rim on said side and end walls;

F) said side panels and said end panels being bent downwardly and inwardly about score lines in said lid, the height of each of said side and end panel corresponding substantially to the height of the tray such that when the lid rests on the tray rim with said panels extending down, perpendicular to the top panel, the lower edges of said panels just engage the surface on which the tray is resting;

G) a removable plastic film tightly enclosing said container sufficient to draw said side and end panels inwardly towards said corresponding side and end walls with each of said side and end panels remaining substantially flat and unattached from corresponding side and end walls such that upon removal of said plastic film, the unrestrained side and end panels naturally flex outwardly into approximately perpendicular relationship with the top panel such that said side and end panels completely shield the metal foil tray from the side walls of the microwave oven when placed therein such that no arcing occurs.

2. The food product package of claim 1 further characterized in that the opposed ends of each of said side and end panels are beveled inwardly from their juncture with said top panel.

* * * * *